US005958224A

United States Patent [19]

Ho et al.

[11] Patent Number: 5,958,224

[45] Date of Patent: Sep. 28, 1999

[54] PROCESS FOR DEEP DESULFURIZATION USING COMBINED HYDROTREATING-OXIDATION

[75] Inventors: Teh Chung Ho; Chang Samuel Hsu, both of Bridgewater, N.J.; Gerald Dennis Dupré, Baton Rouge, La.; Ronald Liotta, Kingswood, Tex.; Viktor Buchholz, Clinton, N.J.

[73] Assignee: Exxon Research and Engineering Co, Florham Park, N.J.

[21] Appl. No.: 09/134,300

[22] Filed: Aug. 14, 1998

[51] Int. Cl.[6] ..... C10G 29/00

[52] U.S. Cl. ..... 208/240; 208/208 R; 208/237; 208/243

[58] Field of Search ..... 208/212, 208 R, 208/237, 240, 243

[56] References Cited

U.S. PATENT DOCUMENTS

| | | | |
|---|---|---|---|
| 3,565,793 | 2/1971 | Herbstman et al. | 202/208 |
| 3,668,117 | 6/1972 | Patel et al. | 208/228 |
| 3,816,301 | 6/1974 | Sorgenti | 208/208 R |
| 3,945,914 | 3/1976 | Yoo et al. | 208/208 R |
| 3,970,545 | 7/1976 | Yoo et al. | 208/212 |
| 3,997,473 | 12/1976 | Schmitt, Jr. et al. | 252/439 |
| 4,051,014 | 9/1977 | Masologites | 208/88 |
| 4,313,852 | 2/1982 | Gavin et al. | 252/439 |
| 4,483,762 | 11/1984 | Grosboll | 208/108 |
| 5,454,933 | 10/1995 | Savage et al. . | |
| 5,474,670 | 12/1995 | Daage et al. | 208/210 |

FOREIGN PATENT DOCUMENTS

| | | | |
|---|---|---|---|
| 0024104 A1 | 2/1981 | European Pat. Off. | C10G 1/00 |
| 0482841 A1 | 4/1992 | European Pat. Off. | C10G 27/04 |
| 0565324 A1 | 10/1993 | European Pat. Off. | C10G 53/14 |
| 2017131 | 1/1990 | Japan | B01J 23/28 |
| 1203102 | 1/1985 | U.S.S.R. | C10G 27/12 |

OTHER PUBLICATIONS

H.L. Barnebey, "Activated Charcoal in the Petrochemical Industry", Nov. 1971, Chemical Engineering Progress (vol. 67, No. 11), pp. 45–48.

F.P. Ballistreri, et.al., "Rates and Mechanism of the Stoichiometric Oxidations of Organic Sulphides to Sulphoxides with the Peroxomolybdenum Complex $MoO(O_2)_2$ HMPT", (Mar. 15, 1988); Journal of Molecular Catalysis, 50 (1989), pp. 39–44.

F.M. Collins, et.al., "Oxidative Desulphurisation of Oils via Hydrogen Peroxide and Heteropolyanion Catalysis", (Apr. 19, 1996), Journal of Molecular Catalysis A: Chemical 117 (1997), pp. 397–403.

M. Boncio, et. al., "The Relative Reactivity of Thioethers and Sulfoxides Toward Oxygen Transfer Reagents: The Oxidation of Thianthrene 5–Oxide and Related Compounds by $MoO_5$HMPT", (Dec. 12, 1994), J. Org. Chem. (1995), 60, pp. 4475–4480.

F.P. Ballistreri, et. al., "The Course of Oxidation Processes of Organic Substrates Mediated by Mo(VI) and W(VI) Polyoxoperoxo Complexes", R. Soc. Chem. (1995), 148 (Organic Reactivity: Physical and Biological Aspects), pp. 429–436.

F.P. Ballistreri, et. al., "Application of the Thianthrene 5–Oxide Mechanistic Probe to Peroxometal Complexes" (Feb. 05, 1991), J. Am.Chem. Soc. (1991), 113, pp. 6209–6212.

F.P. Ballistreri, et. al., "Reactivity of Peroxopolyoxo Complexes. Oxidation of Thioethers, Alkenes, and Sulfoxides by Tetrahexylammonium Tetrakis (diperoxomolybdo) phosphate" (Aug. 05, 1992), J. Org. Chem. (1992), 57, pp. 7074–7077.

F. Di Furia, et. al., "*Synthesis of Chiral Sulfoxides by Metal–Catalyzed Oxidation with t–Butyl Hydroperoxide*", Synthesis (1984), 4, pp. 326–326.

S. Herbstman et. al., Oxidative Desulfurization of Residual Oils, Prepr.—Am. Chem. Soc., Div. Pet. Chem. (1982), 27(4), pp. 826–836.

*Primary Examiner*—Walter D. Griffin
*Assistant Examiner*—Tam M. Nguyen
*Attorney, Agent, or Firm*—Estelle C. Bakun

[57] ABSTRACT

The instant invention is directed to a process for removing hard sulfurs from hydrocarbon streams by selectively oxidizing hard sulfurs in a hydrotreated stream, under oxidizing conditions in the presence of an effective amount of an oxidizing agent, wherein the oxidizing agent is a peroxometal complex and wherein the hard sulfurs are oxidized into the corresponding sulfoxides and sulfones.

10 Claims, 8 Drawing Sheets

Relative Intensity
100.0
212
4, 6-Dimethyl (DBT) (33%)
Mass 212 Chromatogram
View 1
70.9
226
$C_3$ DBT's (28%)
Mass 226 Chromatogram
View 2
54.0
228
Mass 228 Chromatogram
4, 6-dimethyl DBT Sulfoxides (9%)
View 3
59.7
242
Mass 242 Chromatogram
$C_3$ DBT Sulfoxides (10%)
View 4
63.9
244
Mass 244 Chromatogram
4, 6-dimethyl DBT Sulfones (8%)
View 5
49.6
258
Mass 258 Chromatogram
$C_3$ DBT Sulfoxides (11%)
View 6
1300 21:40
1400 23:20
1500 25:00
1600 26:40
1700 28:20
1800 30:00
1900 31:40
SCAN TIME
Retention Time $M^{+\bullet}$
228
211
220
199
185
177
165
152
141
127
120
113
108
106
100
238
251
267
281
295
100.0
50.0
Relative Abundance
100
150
200
250
300
Mass
M/Z $M^{+\bullet}$
244
106
115
122
131
138
150
155
165
171
178
190
201
205
215
227
237
251
256
276
287
297
100.0
50.0
Relative Abundance
150
200
250
300
Mass $M^{+\bullet}$
242
226
199
184
208
220
232
249
257
263
271
285
296
105
119
128
137
147
154
166
179
192
203
100.0
50.0
Relative Abundance
150
200
250
300
Mass M+• 258
215
150
229
243
272
293
209
202
195
185
172
164
157
144
138
134
121
115
109
104
100.0
50.0
Relative Abundance
150
200
250
300
Mass

PROCESS FOR DEEP DESULFURIZATION USING COMBINED HYDROTREATING-OXIDATION

FIELD OF THE INVENTION

Applicants have discovered a process for removal of sterically hindered organosulfur compounds in hydrocarbon mixtures such as petroleum distillates.

BACKGROUND OF THE INVENTION

In the face of ever-tightening sulfur specifications in transportation fuels, sulfur removal from petroleum feedstocks and products will become increasingly important in years to come. While diesel oil's sulfur specification in the U.S. has recently been lowered to 0.05 wt %, indications are that future specifications may go far below the current 0.05 wt % level. Conventional hydrodesulfurization (HDS) catalysts can remove a major portion of the sulfur from diesel fuels, but they are not active for removing the so called "hard sulfur"—the sulfur that is sterically hindered in the multiring aromatic sulfur compound. This is especially true where the sulfur heteroatom is doubly hindered (e.g., 4,6-dimethyldibenzothiophene or 4,6-DMDBT for short). In order to meet stricter specifications in the future, this hard sulfur will also have to be removed from distillate feedstocks and products. There is a pressing need for economical removal of sulfur from distillates and other hydrocarbon products.

One may view the conventional HDS process as a separation device for removing easy sulfurs and multiring aromatics. Easy sulfurs include non-thiophenic sulfur, thiophenes, benzothiophenes, and dibenzothiophenes in which the substituents are away from the sulfur heteroatom. Multiring aromatics in the conventional HDS process are mostly reduced to mononuclear aromatics (e.g., tetralins). Thus, the need essentially is that of removing hard sulfurs from a "sea" of mononuclear aromatics. The present invention addresses this pressing need.

SUMMARY OF THE INVENTION

The instant invention is directed to a process for removing hard sulfurs from hydrocarbon streams comprising: selectively oxidizing hard sulfurs in a hydrotreated stream, under oxidizing conditions in the presence of an effective amount of an oxidizing agent, wherein said oxidizing agent is a peroxometal complex and wherein said hard sulfurs are oxidized into the corresponding sulfoxides and sulfones.

The invention is further directed to a process according to the above wherein the process further comprises adsorbing said oxidation products and recovering a product stream having a reduced concentration of hard sulfurs and oxidation products.

Hydrotreated stream as used herein means a stream that has had the amount of easy sulfurs contained therein reduced or removed in a conventional HDS process.

DETAILED DESCRIPTION OF THE INVENTION

Figure 1:
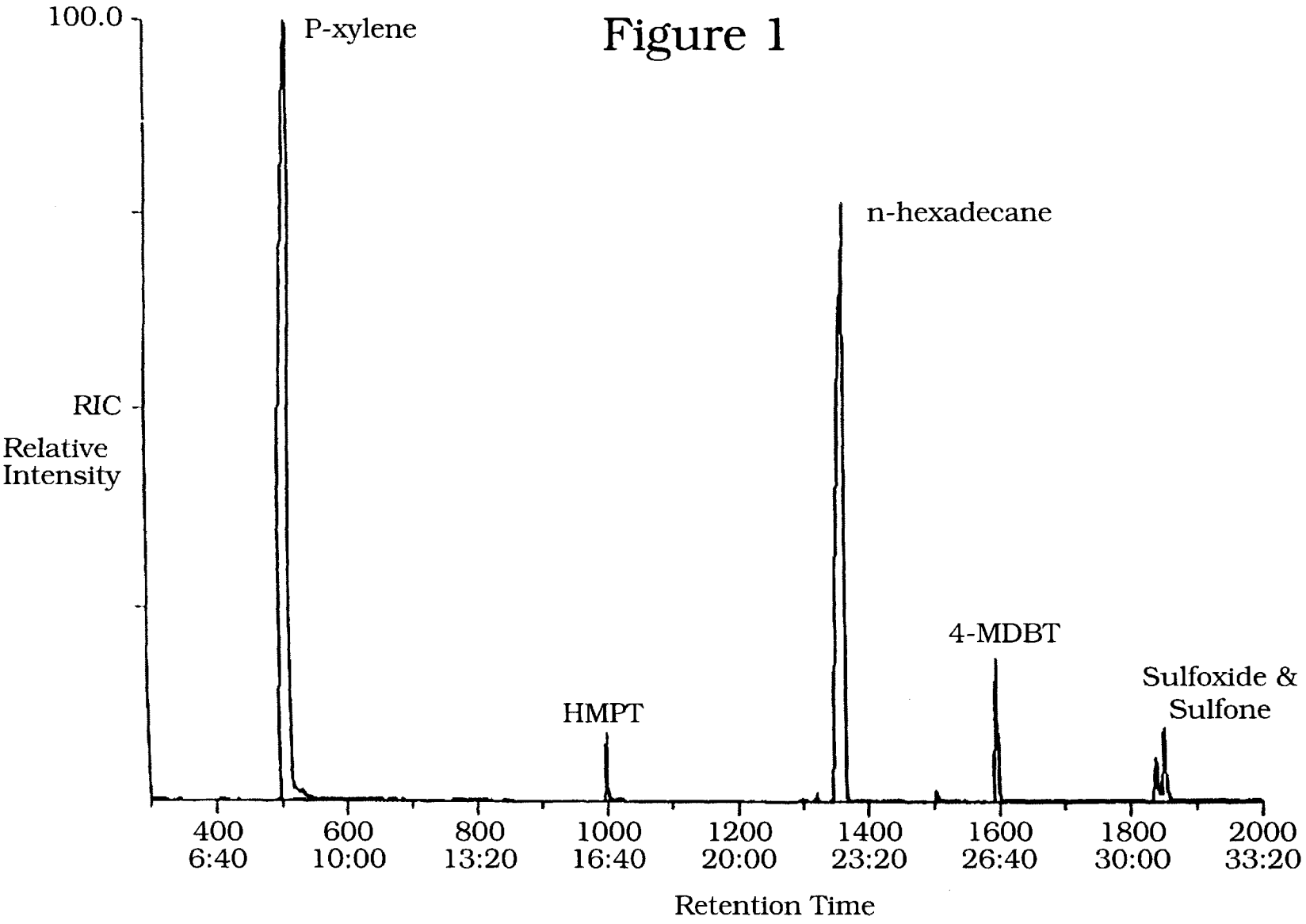
FIG. 1 is a GC/MS total ion chromatogram of products from the oxidation of 4-MDBT/xylene with (HMPT)MoO$(O_2)_2$.

It is well known that sterically hindered alkyldibenzothiophenes, due to their low reactivity, are difficult to desulfurize on conventional HDS catalysts. Using high temperatures would cause yield loss, faster catalyst coking, and product quality deterioration (e.g., color). Using high pressure requires a large capital outlay. Applicants have found that once the easy sulfurs are removed by hydrotreating with conventional HDS catalysts, selective removal of the remaining hard sulfurs can be accomplished by oxidizing the hydrotreated stream utilizing a transition metal peroxide as the oxidizing agent in amounts that are greater than or equal to that required by stoichiometry. Beneficially, the instant process is very selective in that the peroxometal complex preferentially oxidizes hard sulfurs rather than aromatics.

The oxidant utilized in the instant invention is a peroxometal complex represented by one of the following formulas $LMO(O_2)_2$, $(LL')MO(O_2)_2$, and $LMO(O_2)_2.H_2O$ wherein M is selected from the group consisting of Mo, W, Cr and mixtures thereof and wherein L and L' are neutral ligands. Illustrative but non-limiting examples of ligands useful in this invention include hexamethylphosphoric triamide (HMPT), dimethylformamide (DMF), pyridine, etc. Preferably, Mo will be the metal and HMPT the preferred ligand. Hence, if HMPT is used as the ligand and when M is Mo, the diperoxo complex is of the formula $(HMPT)_2MoO(O_2)_2$. This complex can be prepared from the reaction of molybdenum oxide with $H_2O_2$ or hydroperoxide in the presence of said ligand. Similarly, the complex (HMPT)$MoO(O_2)_2.H_2O$ can also be prepared. In this case, the weakly bound water molecule can easily be removed and the resulting molybdenum peroxide becomes (HMPT)MoO$(O_2)_2$, or $[(CH_3)_2N]_3POMoO(O—O)_2$. The preparation of the peroxometal complexes is easily carried out by the skilled artisan and will be further understood by reference to the Examples, infra.

Applicants believe the oxidation reaction involves oxygen transfer from the transition metal peroxide to the hard sulfur. To replenish the lost oxygen atom in the metal peroxide, one may add an appropriate amount of hydrogen peroxide or hydroperoxide (ROOH) to the reaction system. The hydrogen peroxide or hydroperoxide will replenish the lost oxygen of the peroxometal complex. Appropriate amount as used herein is the stoichiometric amount necessary to replenish the peroxometal complex and is readily determined by the skilled artisan. The peroxometal complex oxidizes the hard sulfurs into their corresponding sulfoxides and sulfones with negligible if any co-oxidation of mononuclear aromatics. These oxidation product due to their high polarity, can be readily removed by conventional separation techniques such as adsorption and extraction. The high selectivity of the oxidants, coupled with the small amount of hard sulfurs in hydrotreated streams, makes the instant invention a particularly effective deep desulfurization means with minimum yield loss. The yield loss corresponds to the amount of hard sulfurs oxidized. Since the amount of hard sulfurs present in a hydrotreated crude is rather small, the yield loss is correspondingly small.

The adsorption step can employ solid adsorbents capable of removing sulfoxides and sulfones. Non-limiting examples of such adsorbents, commonly known to the skilled artisan, include activated carbons, activated bauxite, activated clay, activated coke, alumina, and silica gel. Preferred solid adsorbents should have pores large enough to adsorb the multiring oxidation products and the hard sulfurs. A commercially available activated carbon useful in the instant invention is FILTRASORB 400.

Typically, the oxidation will be conducted under conditions known to the skilled artisan. The oxidation reactions are rather mild and can even be carried out at temperatures as low as room temperature. Such conditions will be capable of converting the hard sulfurs into their corresponding sulfoxides and sulfones at reasonable rates and are known to the skilled artisan.

The amount of peroxometal complex necessary for the instant invention is the stoichiometric amount necessary to, oxidize the hard sulfurs contained in the hydrotreated stream being treated in accordance herewith. Preferably an amount which will oxidize all of the hard sulfurs will be used.

The following examples are illustrative and are not meant to be limiting.

EXAMPLE 1

Preparation of Oxidant

As an illustrative example, $(HMPT)MoO(O_2)_2$ can be obtained as follows. Five grams molybdenum oxide (VI) and 25 cc hydrogen peroxide (30%) were placed in a flask and heated to 40° C. and stirred for 15 minutes at 40° C. The resulting light yellow suspension was cooled to 10° C. using ice water with stirring. To this suspension was added 6.23 grams HMPT dropwise and a yellow solid immediately formed. To facilitate siring, 15 cc of ether was added at 10° C. for 30 minutes. The solid product was filtered under vacuum with multiple ether washes. The product was then dried in a vacuum oven for 1 hour at 30–35° C. 9.1 grams of product were obtained and recrystallized from methanol at 40° C. The resulting mixture was filtered and methanol was removed via evaporation. A yellow solid product was obtained.

EXAMPLE 2

Model Feed Mixture on $(HMPT)MoO(O_2)_2$

A severely hydrotreated stream generally contains a large amount of mononuclear aromatics and a small amount of hard sulfurs. Accordingly, a model feed mixture of 5 wt % 4-methyldibenzothiophene (4-MDBT), 70 wt % p-xylene, and 25 wt % hexadecane was used. The purpose of this example was to show that $(HMPT)MoO(O_2)_2$ is such a selective oxidant that it oxidizes 4-MDBT without cooxidation of p-xylene.

Batch oxidation experiments were conducted as follows. Five grams of the feed mixture were dissolved in 125 cc methylene chloride ($CH_2Cl_2$) at 40° C. In a separate flask, 0.53 g of $(HMPT)MoO(O_2)_2$ was dissolved in 15 cc $CH_2Cl_2$. The latter was then added to the feed-containing solution at once at 40° C. with stirring. The reaction was terminated by adding 250 cc 1N HCl with stirring for 15 min. The resulting mixture was placed in a separatory funnel to separate out the organic phase (bottom portion). The organic phase was further washed with 200 cc 1N HCl and 150 cc distilled water and filtered. The solvent/volatiles were evaporated in a rotovapor at 38° C.

Figure 2:
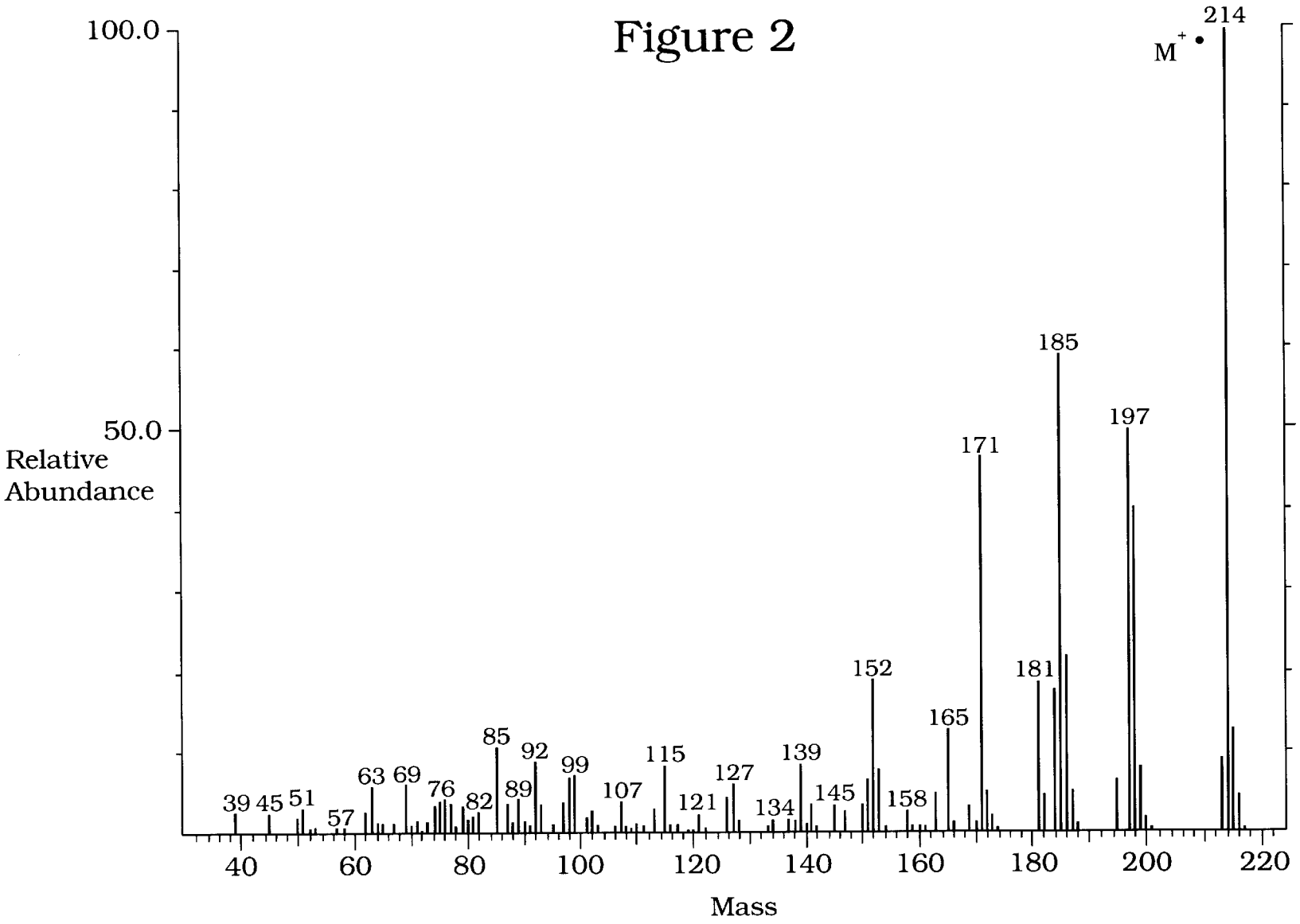
FIG. 2 is the 70-eV electron ionization mass spectrum of 4-MDBT sulfoxide.
Figure 3:
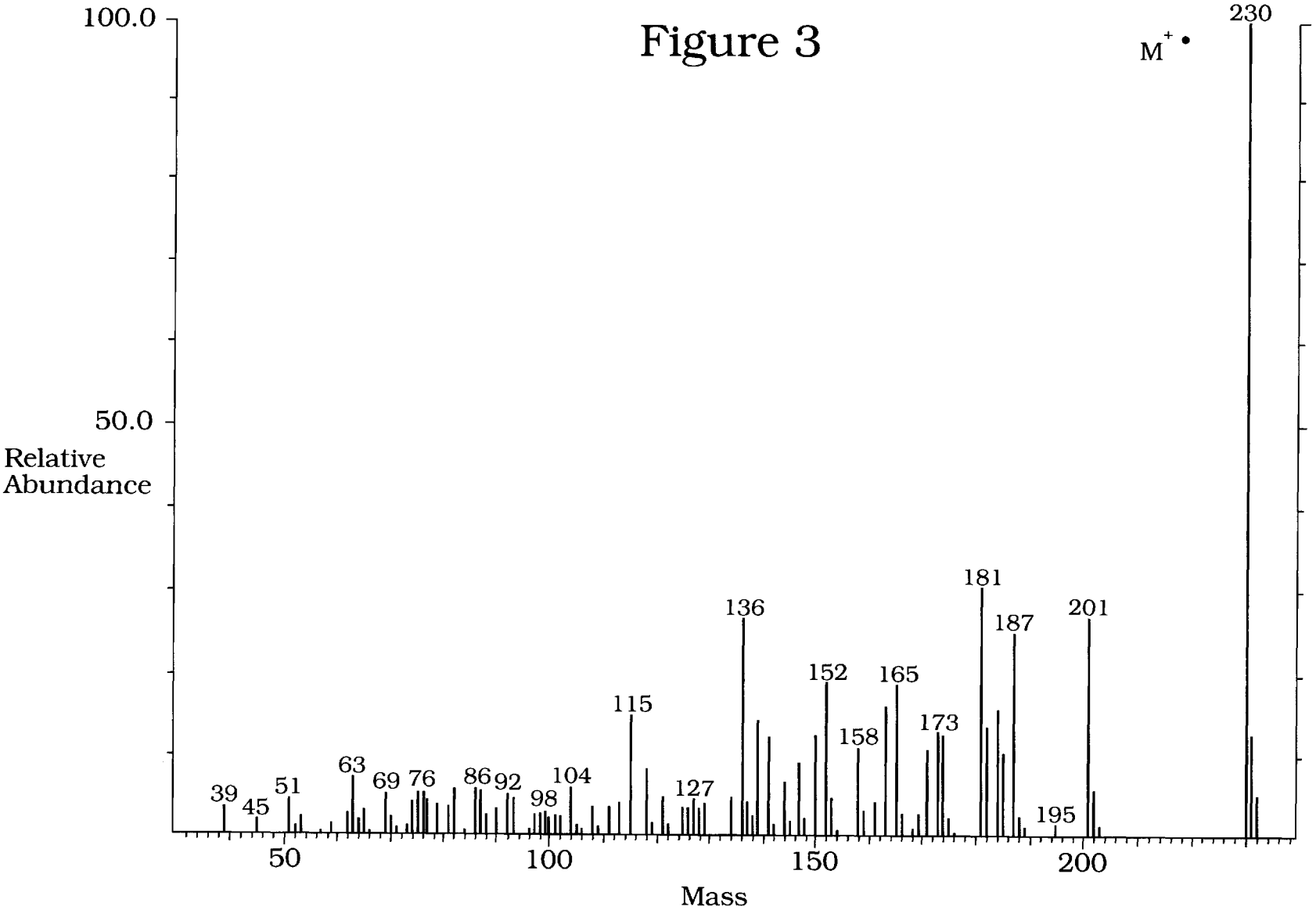
FIG. 3 is the 70-eV electron ionization mass spectrum of 4-MDBT sulfone.

FIG. 1 shows the GC/MS total ion chromatogram of the oxidation products obtained from the above experiment. Approximately half of the feed 4MDBT was oxidized to sulfoxide and sulfone. Moreover, xylene was not oxidized. FIGS. 2 and 3 are the 70-eV electron ionization (EI) mass spectra of 4MDBT sulfoxide and sulfone, respectively. The molecular ions at mass-to-charge ratio of 214 and 230 are the most predominant ionic species present due to the stability of molecular ions with full aromaticity.

EXAMPLE 3

Model Feed Mixture on $H_2O_2$

Here the purpose was to show that if $H_2O_2$ is used as the oxidant, mononuclear aromatics get oxidized to aldehydes. The experimental procedure used in this example is the same as that used in Example 2 except that 0.148 grams of $H_2O_2$ was added to the feed mixture instead of $(HMPT)MoO(O_2)_2$. It was found that xylene was oxidized to p-methyl benzaldehyde, while 4MDBT was not oxidized at all.

EXAMPLE 4

Mid-distillate Feed on $(HMPT)MoO(O_2)_2$

In this example, the feed was a hydrotreated virgin middle distillate containing 390 ppm total sulfur. Inspection of this distillate with a sulfur-specific GC indicated that there are at least five hard sulfur species that survived hydrotreating. The largest one is 4,6-DMDBT. The rest are sterically hindered ethyl methyl and trimethyl DBTS. The oxidation reaction at room temperature proceeded as follows: five grams of oil were dissolved in 125 cc $CH_2Cl_2$ and 3.55 grams of $(HMPT)MoO(O_2)_2$ were dissolved in 100 cc $CH_2Cl_2$. The solutions were combined at room temperature with stirring and stirred for 12 minutes. 300 cc 1N HCl was added and stirred for 15 minutes. The organic phase (the bottom portion) was then separated out and washed with 1N HCl followed by distilled water. The product was filtered and solvent evaporated.

Figure 4:
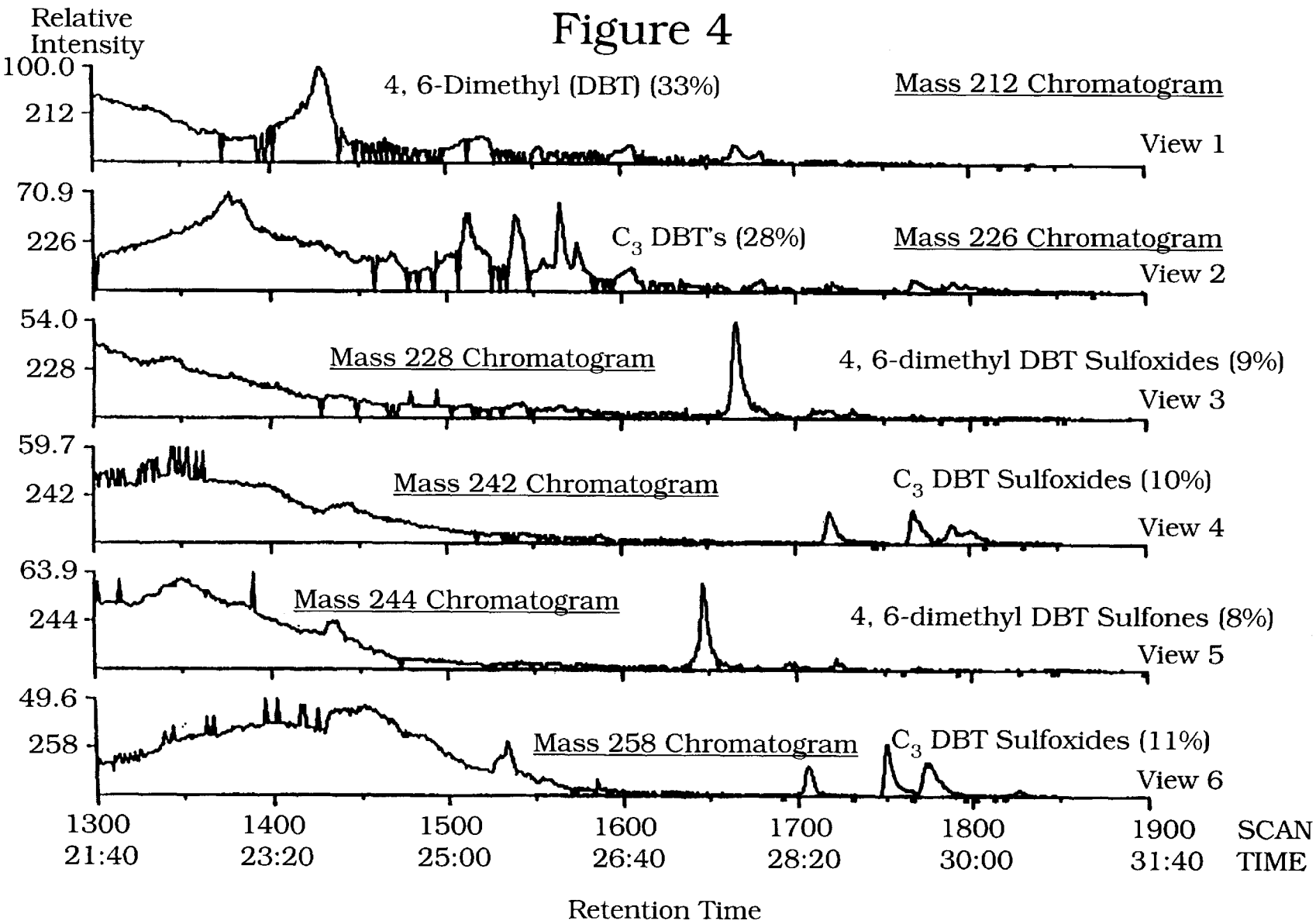
FIG. 4 is a Mass chromatograms (top four traces) and GC/MS total ion chromatogram (bottom trace) for products from the oxidation of a middle distillate with (HMPT)MoO$(O_2)_2$.
Figure 5:
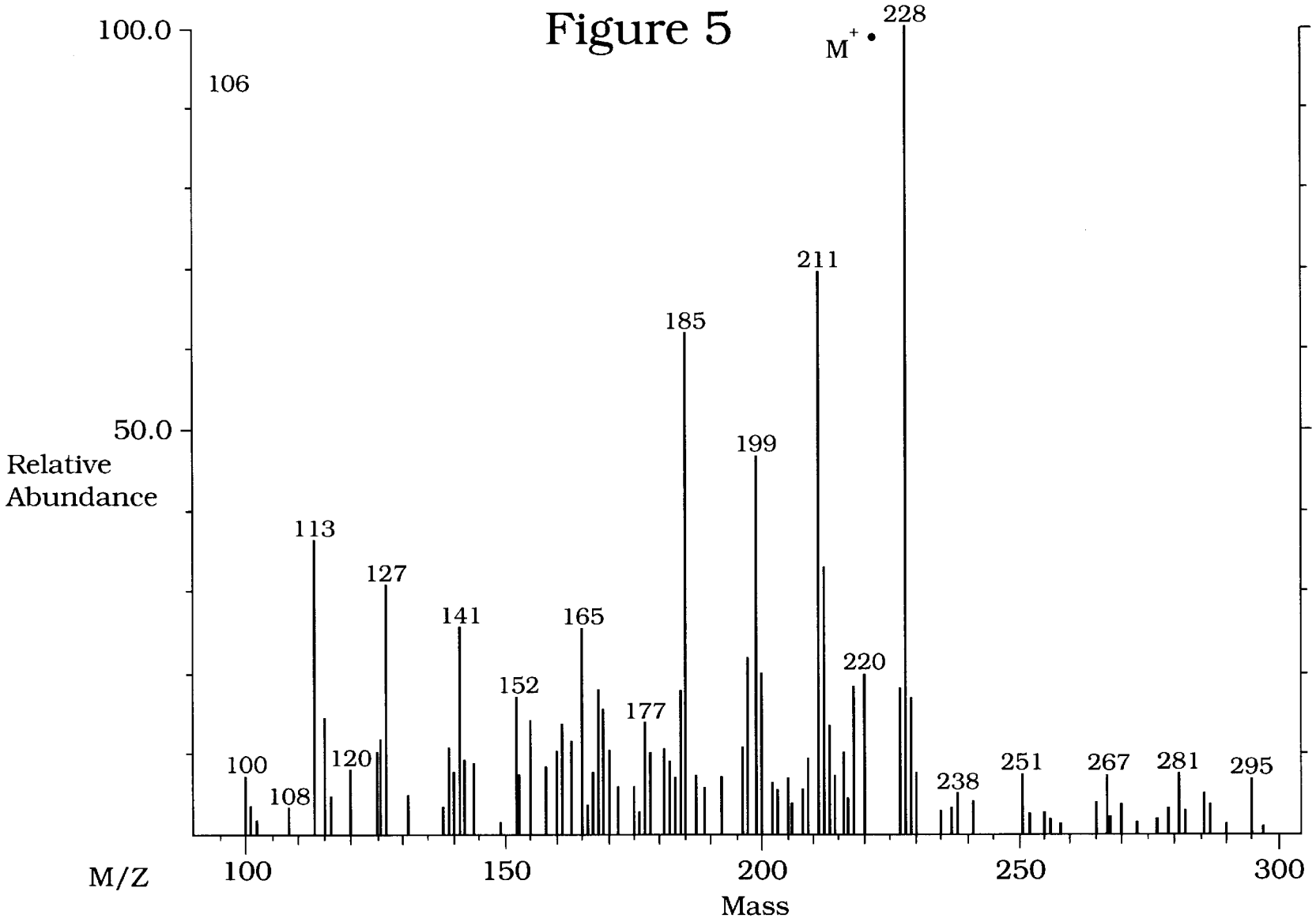
FIG. 5 is the 70-eV electron ionization mass spectrum of 4,6-DMDBT sulfoxide.
Figure 6:
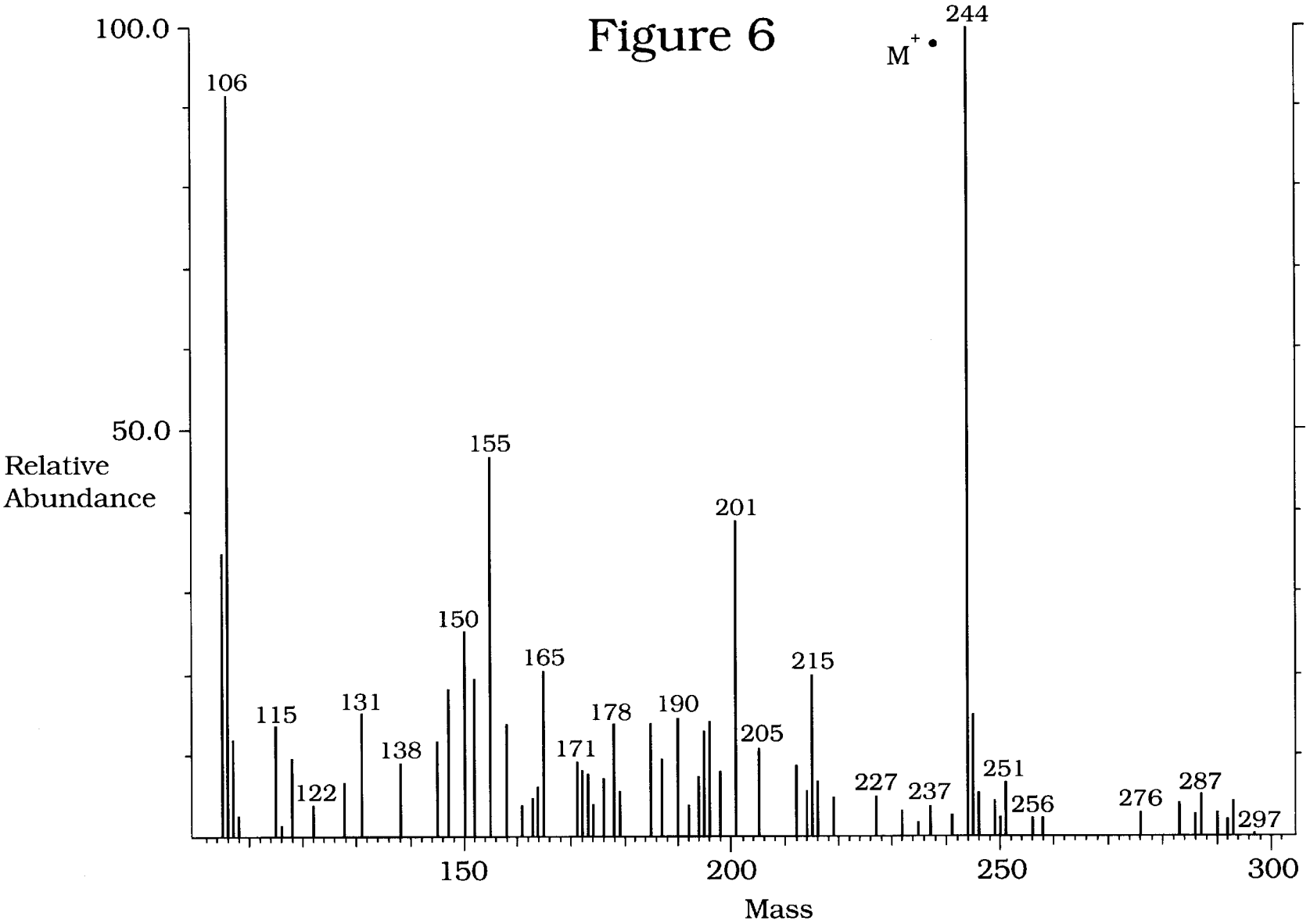
FIG. 6 is the 70-eV electron ionization mass spectrum of 4,6-DMDBT sulfone.
Figure 7:
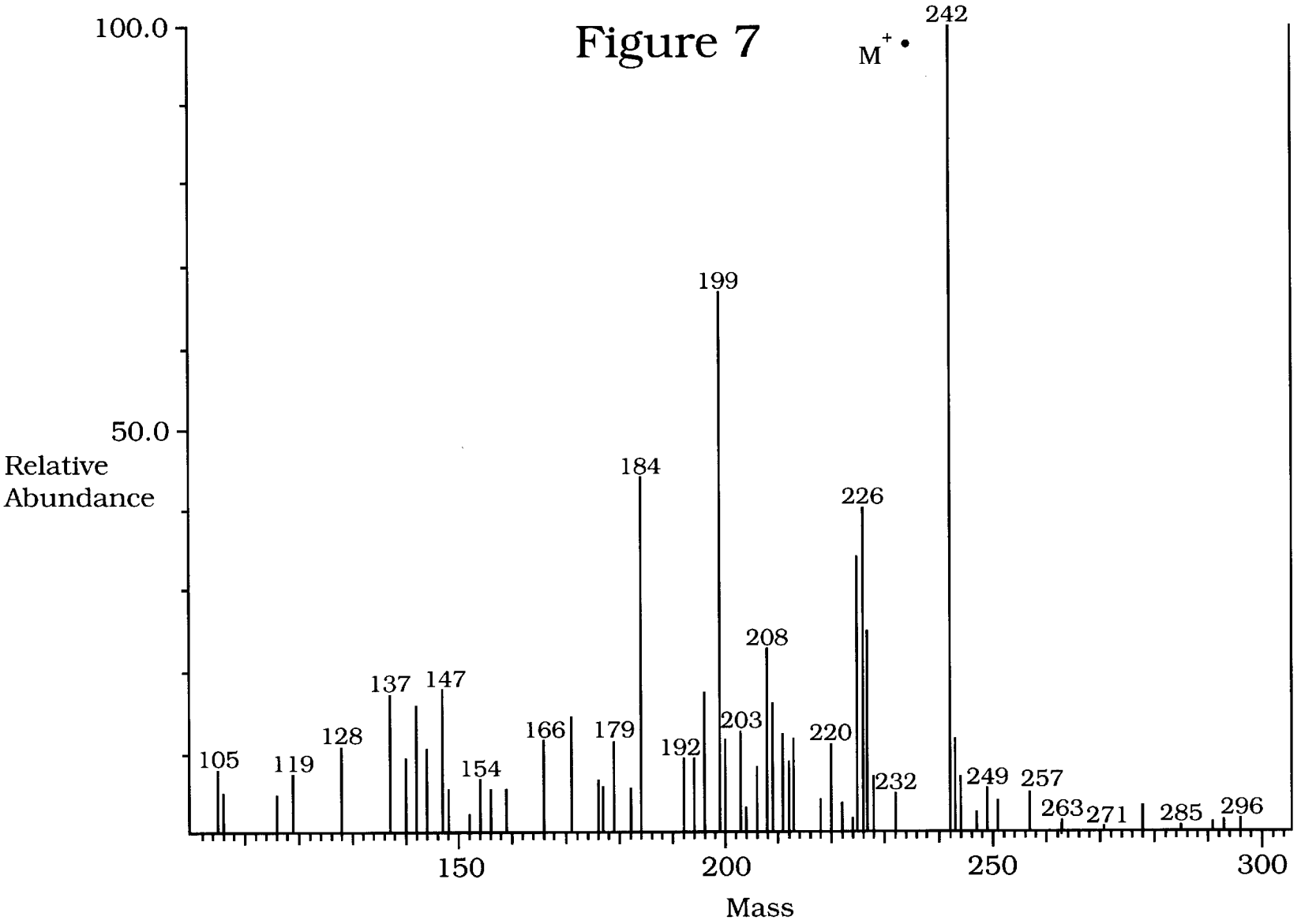
FIG. 7 is the 70-eV electron ionization mass spectrum of hindered $C_3$-DBT sulfoxide.
Figure 8:
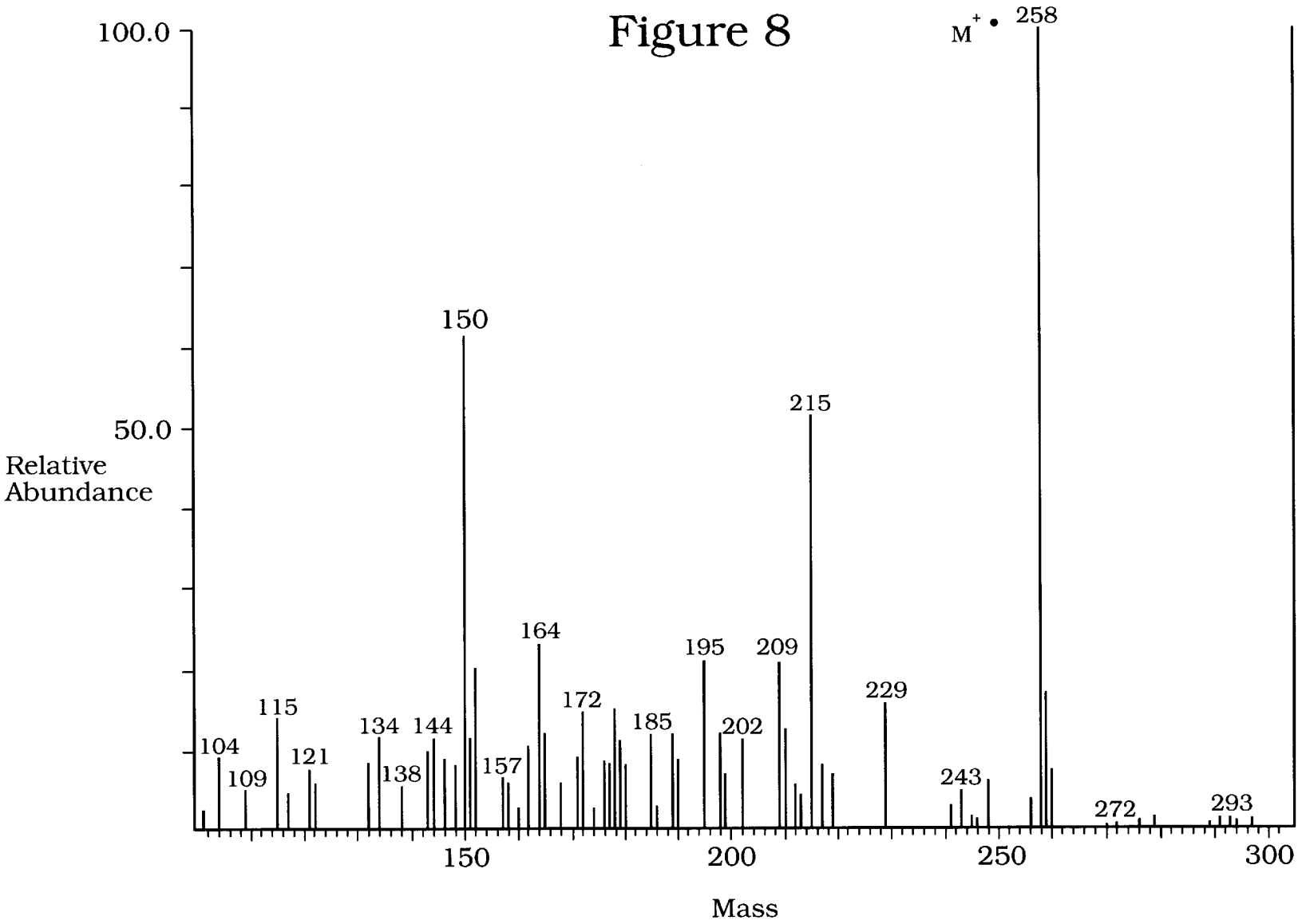
FIG. 8 is the 70-eV electron ionization mass spectrum of hindered $C_3$-DBT sulfone.

FIG. 4 is the GC/MS selective ion chromatogram showing that hard sulfurs were removed. The six ion current traces shown in FIG. 4 monitor the molecular ions of the sulfur compounds of interest and show the distributions of alkyldibenzothiophenes and their corresponding sulfones and sulfoxides. For example, 4,6-DMDBT with molecular weight 212 is shown in the mass 212 chromatogram. The sulfone and sulfoxide derived from 4,6-DMDBT are found in the mass 228 and 244 chromatograms, respectively. Over 40% of 4,6-DMDBT and $C_3$ DBTs (ethylmethyl and trimethyl DBTs) were oxidized forming about equal amounts of sulfones and sulfoxides. FIGS. 5 and 6 are the 70-eV EI mass spectra of 4,6-DMDBT sulfoxide and sulfone, respectively. The molecular ions of mass-to-charge ratio of 228 and 244 are the most intensive peak in these spectra. Similarly, approximately half of the sterically hindered $C_3$ DBT isomers, shown in the mass 226 chromatogram, are oxidized into the corresponding sulfoxide and sulfone (mass 242 and 258 chromatograms). All of the isomers yield similar 70-eV El mass spectra. FIGS. 7 and 8 show typical 70-eV EI mass spectra of the $C_3$ DBT sulfoxide and sulfone, with the molecular ions of 242 and 258 predominant in the spectra.

EXAMPLE 5

Comparative Experiments

The objective here was to demonstrate that sulfoxides and sulfones can be readily separated out by adsorption. Two comparative experiments, 5A and 5B, were performed. Experiment 5A was the base case of direct removal of 4MDBT via adsorption using the activated carbon FILTRASORB 400 as the adsorbent. Experiment 5B removed 4MDBT via the oxidation followed by adsorption. The feed used contained 13.62 wt % 4MDBT, 0.84 wt % DBT, and 85.54 wt % hexadecane. The products obtained from both experiments were analyzed by GC and mass spec.

EXAMPLE 5A

Removal of Hard Sulfur by Adsorption

The batch adsorption was done with an oil-to-adsorbent weight ratio of 6.5 at ambient conditions for 64 hours. The product after adsorption was analyzed by GC/MS. Table 1 summarizes the results. As can be seen, 44.5% of 4MDBT was removed from the feed.

EXAMPLE 5B

Removal of Hard Sulfur by Adsorption and Preoxidation

The removal of 4MDBT by FILTRASORB 400 can be significantly improved by preoxidation. As Table 1 shows, the concentration of 4MDBT after adsorption-followed-by-oxidation is only 0.77 wt %, corresponding to a 94.3% removal of 4MDBT as opposed to the 44.5% of Example 5A.

TABLE 1

4 MDBT and DBT Contents of Feed and Products

| Stream | 4 MDBT, wt % | DBT, wt % |
|---|---|---|
| Feed | 13.62 | 0.84 |
| 5A: products after adsorption | 7.55 | 0.70 |
| 5B: products after oxidation-adsorption | 0.77 | 0.04 |

The above examples show the significant improvement of adsorptive removal via preoxidation. The same should be true if adsorption is replaced by other separation methods such as extraction because the polarity of the oxidation products is much higher than that of hard organosulfurs such as alkyldibenzothiophenes.

What is claimed is:

1. A process for removing sterically hindered heterocyclic sulfur compounds from hydrotreated hydrocarbon streams which have undergone hydrodesulfurization comprising oxidizing said sterically hindered heterocyclic sulfurs in a hydrotreated stream, under oxidizing conditions in the presence of an effective amount of an oxidizing agent wherein said oxidizing agent is a peroxometal complex selected from the group consisting of one of the following forms: $LMO(O_2)_2$, $(LL')MO(O_2)_2$, $LMO(O_2)_2.H_2O$, and mixtures thereof, wherein M is selected from the group consisting of Mo, W, Cr and mixtures thereof and wherein L and L' are neutral ligands and wherein said sterically hindered sulfurs are converted into oxidation products.

2. A process according to claim 1 further comprising adsorbing said oxidation products and recovering a product stream having a reduced concentration of hard sulfurs and oxidation products.

3. A process according to claim 1 wherein said peroxometal complex is a $LMoO(O_2)_2$ complex.

4. A process according to claim 3 wherein L in said $LMoO(O_2)_2$ is an alkylphosphoric triamide.

5. A process according to claim 4 wherein said alkylphosphoric triamide is hexamethyl phosphoric trimide.

6. A process according to claim 1 wherein said peroxometal complexes are regenerated following formulation of said oxidation products by adding a regenerating agent selected from the group consisting of hydroperoxides, hydrogen peroxide or mixtures thereof.

7. A process according to claim 2 wherein said adsorption utilizes an adsorbent selected from the group consisting of activated carbons, activated bauxite, activated clay, activated coke, silica gel, alumina, and mixtures thereof.

8. A process according to claim 2 wherein said adsorption utilizes activated carbon as an adsorbent.

9. A process according to claim 1 wherein said sterically hindered heterocyclic sulfur compounds are alkyldibenzothiophenes.

10. A process according to claim 9 wherein said alkyldibenzothiophenes are 4,6-dimethyldibenzothiophenes.

* * * * *